US009085859B2

(12) United States Patent
Andic

(10) Patent No.: US 9,085,859 B2
(45) Date of Patent: Jul. 21, 2015

(54) SNOW PLOW ASSEMBLY

(76) Inventor: Mike Mile Andic, Woodstock (CA)

( * ) Notice: Subject to any disclaimer, the term of this patent is extended or adjusted under 35 U.S.C. 154(b) by 678 days.

(21) Appl. No.: 13/354,130

(22) Filed: Jan. 19, 2012

(65) Prior Publication Data

US 2012/0180347 A1 Jul. 19, 2012

Related U.S. Application Data

(60) Provisional application No. 61/434,157, filed on Jan. 19, 2011.

(51) Int. Cl.
*E01H 5/06* (2006.01)
*E01H 5/07* (2006.01)

(52) U.S. Cl.
CPC ... *E01H 5/06* (2013.01); *E01H 5/07* (2013.01)

(58) Field of Classification Search
CPC ..... E01H 5/065–5/067; E01H 5/06–5/07
See application file for complete search history.

(56) References Cited

U.S. PATENT DOCUMENTS 2,663,098 A * 12/1953 Frink et al. ..... 37/274
3,055,126 A * 9/1962 Emhof ..... 37/280
3,407,519 A * 10/1968 Batko ..... 37/280
3,410,008 A * 11/1968 Standfuss ..... 37/231
3,807,064 A * 4/1974 Schmidt, Jr. ..... 37/283
4,019,268 A * 4/1977 Waterman ..... 37/219
4,077,139 A * 3/1978 Fagervold et al. ..... 37/280
4,217,707 A * 8/1980 Karlsson ..... 37/280
4,372,617 A * 2/1983 Zamboni ..... 299/24
4,446,639 A * 5/1984 Bohn ..... 37/280
4,552,226 A * 11/1985 Platter ..... 172/815
4,614,048 A * 9/1986 Melby ..... 37/280
4,667,426 A * 5/1987 Howard et al. ..... 37/232
4,723,609 A * 2/1988 Curtis ..... 172/815
5,638,617 A * 6/1997 Belanger et al. ..... 37/270
5,758,728 A * 6/1998 Ragule ..... 172/815
5,819,444 A * 10/1998 Desmarais ..... 37/281
5,860,230 A * 1/1999 Daniels ..... 37/232
5,903,986 A * 5/1999 Parker ..... 37/281
5,921,326 A * 7/1999 Ragule ..... 172/815
6,363,631 B1 * 4/2002 Cordingley ..... 37/280
6,412,199 B1 * 7/2002 Quenzi et al. ..... 37/281
6,425,196 B1 * 7/2002 Weagley et al. ..... 37/270
6,877,258 B2 * 4/2005 Frey ..... 37/281
7,100,311 B2 * 9/2006 Verseef ..... 37/234
7,360,327 B2 * 4/2008 Osgood et al. ..... 37/444
7,481,011 B2 * 1/2009 Nesseth ..... 37/281
7,640,682 B1 * 1/2010 Buckbee ..... 37/281
7,681,337 B2 * 3/2010 Watson ..... 37/281
7,918,042 B2 * 4/2011 Ropog ..... 37/281
7,941,947 B2 * 5/2011 Stephan ..... 37/231
8,061,063 B2 * 11/2011 Gamble, II ..... 37/281
8,069,590 B2 * 12/2011 Schmeichel ..... 37/232

(Continued)

FOREIGN PATENT DOCUMENTS

WO WO 2006072184 A1 * 7/2006

*Primary Examiner* — Thomas B Will
*Assistant Examiner* — Joan D Misa

(57) ABSTRACT

A snow plow assembly comprising a main plow body, at least one butterfly gate, at least one blocker and a diverter. The at least one butterfly gate and the at least one blocker are jointly connected to the main plow body and are controlled by actuators to be opened and closed. The actuators allow the users to control when to release or hold snow collected into the main plow body. This feature is used to prevent the buildup of high snow ridges in front of small pathways such as driveways.

17 Claims, 6 Drawing Sheets

(56) References Cited

U.S. PATENT DOCUMENTS 8,096,066 B2 * 1/2012 Gandolfi ..... 37/274
8,127,472 B2 * 3/2012 Kotila ..... 37/281
8,499,477 B2 * 8/2013 Gamble, II ..... 37/281
2003/0226289 A1 * 12/2003 Geerligs ..... 37/268
2008/0244935 A1 * 10/2008 Crimmins ..... 37/266

* cited by examiner

SNOW PLOW ASSEMBLY

The current application claims a priority to the U.S. Provisional Patent application Ser. No. 61/434,157 filed on Jan. 19, 2011.

FIELD OF THE INVENTION

The present invention relates generally to a snow plow assembly that allows a user to control the release and collection of snow while plowing. More specifically, the snow plow assembly comprises a gate and a blocker to prevent snow from escaping the scoop cavity when needed.

BACKGROUND OF THE INVENTION

The present invention resolves the problem of blocking the side streets, driveway entrances, access to bus stops, etc. during the snow clearing operations in urban areas. The present invention does so in a rapid, continuous fashion, automatically, without the input from a vehicle operator.

After the present invention removes the snow (in a "Standard" mode) from the street surface, it disposes the same to the side of the street in a selective fashion ("Selective" mode), by choosing to leave the side openings ("Windows"), like driveways, cross-streets, bus stops, etc. free of snow deposits, thus not blocking those areas with the high snow ridges, common with present snow-cleaning technology.

The present invention is designed to be used for rapid and continuous removal of the snow from the streets and other paved surfaces in mostly municipal environment during the snow season. It will substantially improve efficiency, cost effectiveness, environmental benefits and safety over the presently used technology.

As the leftover snow accumulates along the sidewalks and side street passages at intersections, the old technology leaves the job of cleaning the streets partially undone. In turn, a second vehicle is needed to clear the sidewalks and side street passages and other "windows". It is therefore an object of the present invention to introduce a robotic machine for the selective disposal of snow removed from the street surface. In certain embodiments the plow truck may be guided and controlled by the GPS. The present invention resolves the problem of blocking the side streets, driveway entrances, access to bus stops, etc. during the snow clearing operations. The present invention does so in a rapid, continuous fashion automatically, without the input from a vehicle operator. It is a further object of the present invention to eliminate the need for a second vehicle, or same vehicle coming back to "open" the side street passage at the intersections, thus reducing the vehicle fleets. It is yet a further object of the present invention to reduce exhaust emissions, for all that is needed is one vehicle to do the work alone. The present invention eliminates the need for human involvement, thus safety and speed of operation are vastly improved. The present invention greatly improves the efficiency of the operation by eliminating any snow "leaks" or residue left behind, by using the newly designed "butterfly" gates. The present invention reduces the labor and operating costs for cleaning the streets.

DETAIL DESCRIPTIONS OF THE INVENTION

All illustrations of the drawings are for the purpose of describing selected versions of the present invention and are not intended to limit the scope of the present invention.

The present invention is a snow plow assembly that is able to selectively plow snow towards the sides of a street. The objective is to prevent the build-up of high snow ridges onto the entrance of side streets, driveways, or any other small pathways directly adjacent to a street being plowed. The present invention is able to achieve this by introducing a gate system with an actuating system that can be controlled to allow snow to escape from the scoop cavity 13 or be contained within the scoop cavity 13 until released.

Figure 1:
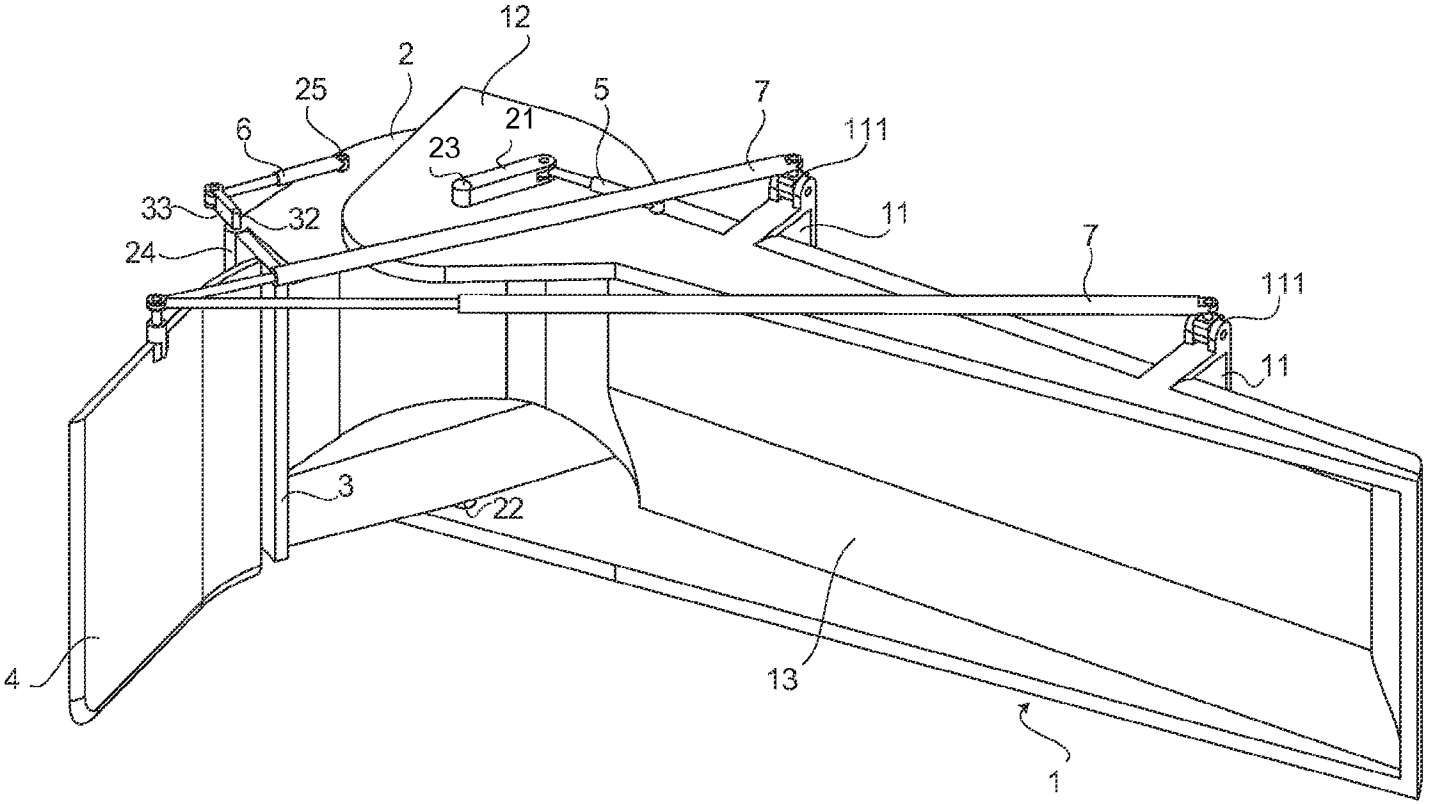
FIG. 1 is a perspective view of the present invention.
Figure 2:
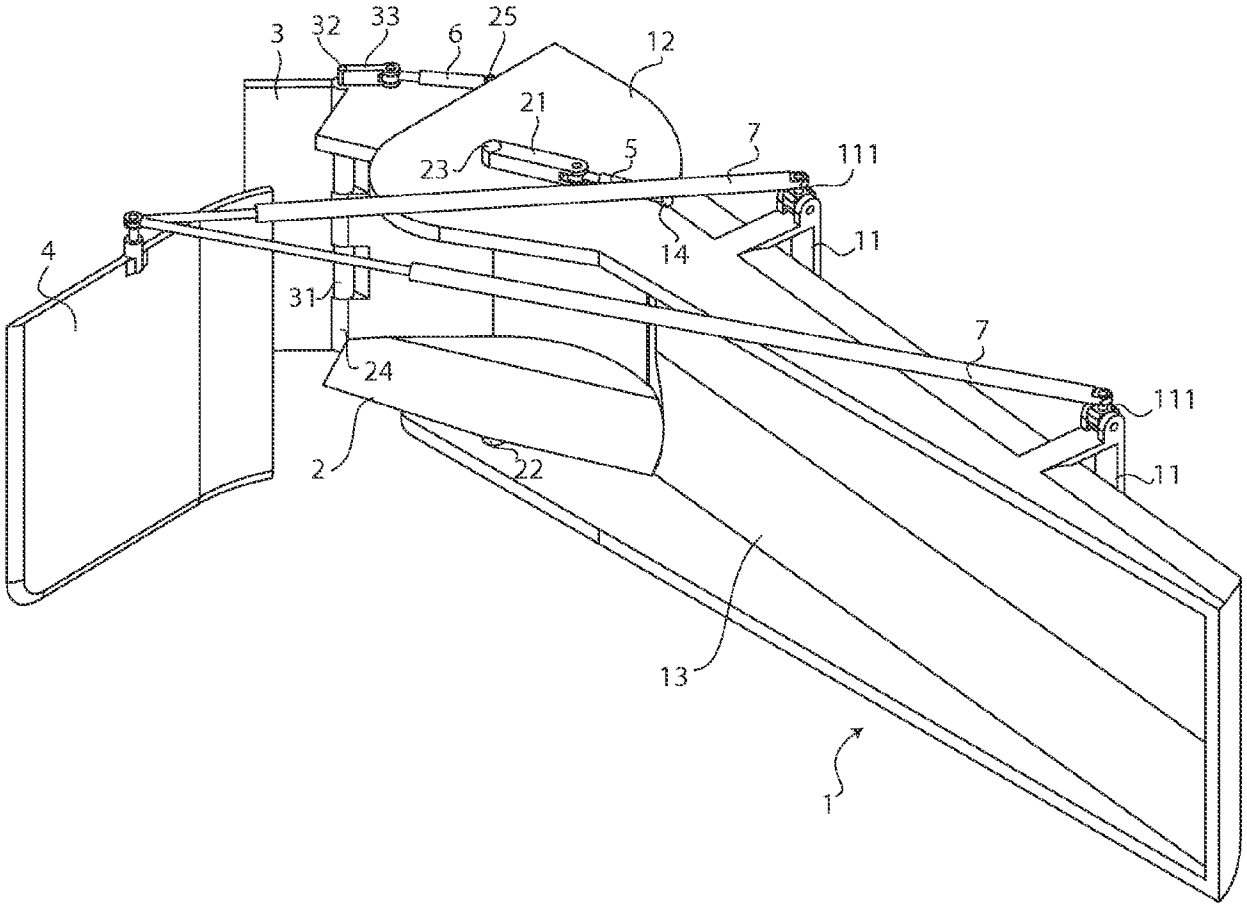
FIG. 2 is a perspective view of the present invention showing the butterfly gate and the blocker in a straight open position.
Figure 3:
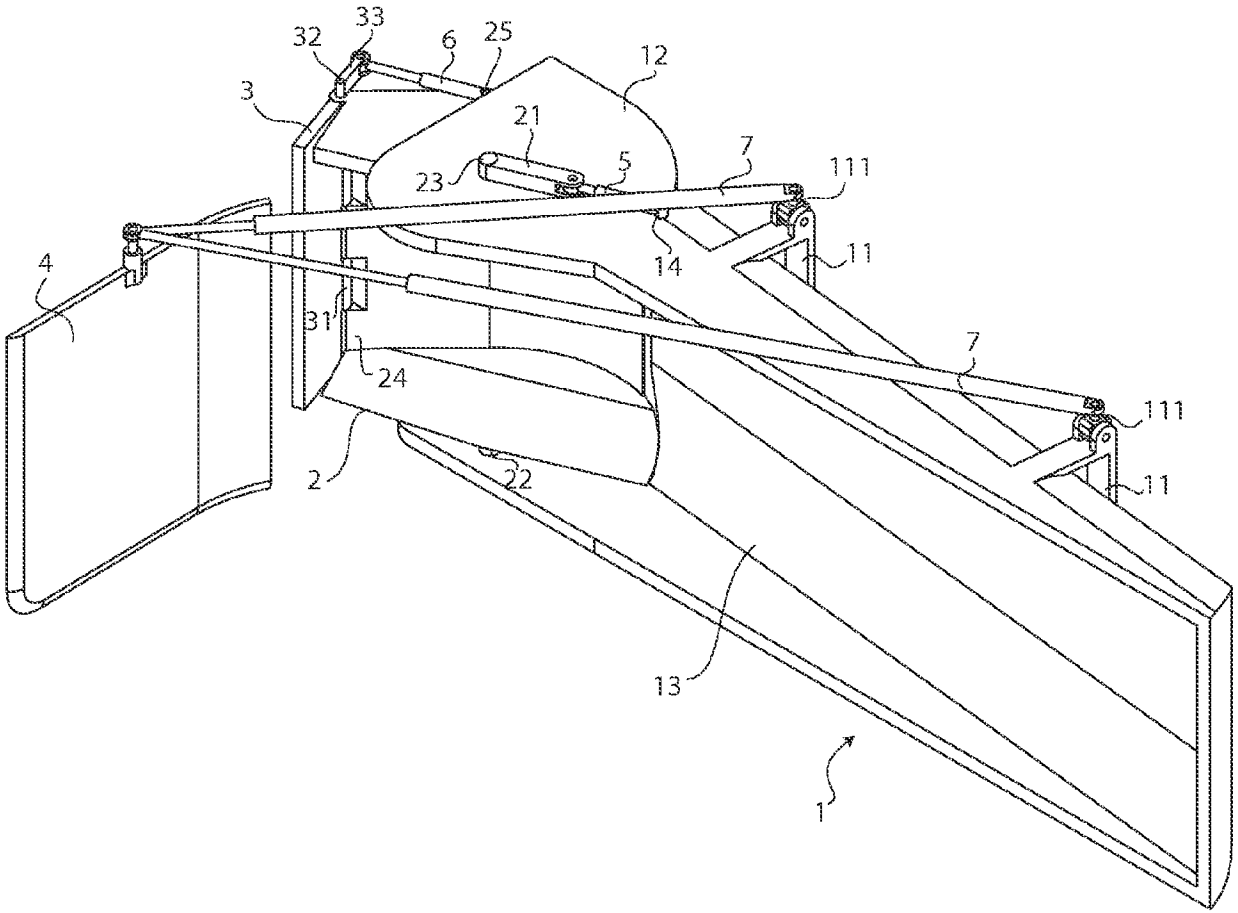
FIG. 3 is a perspective view of the present invention showing the blocker first moving into a closed position.
Figure 4:
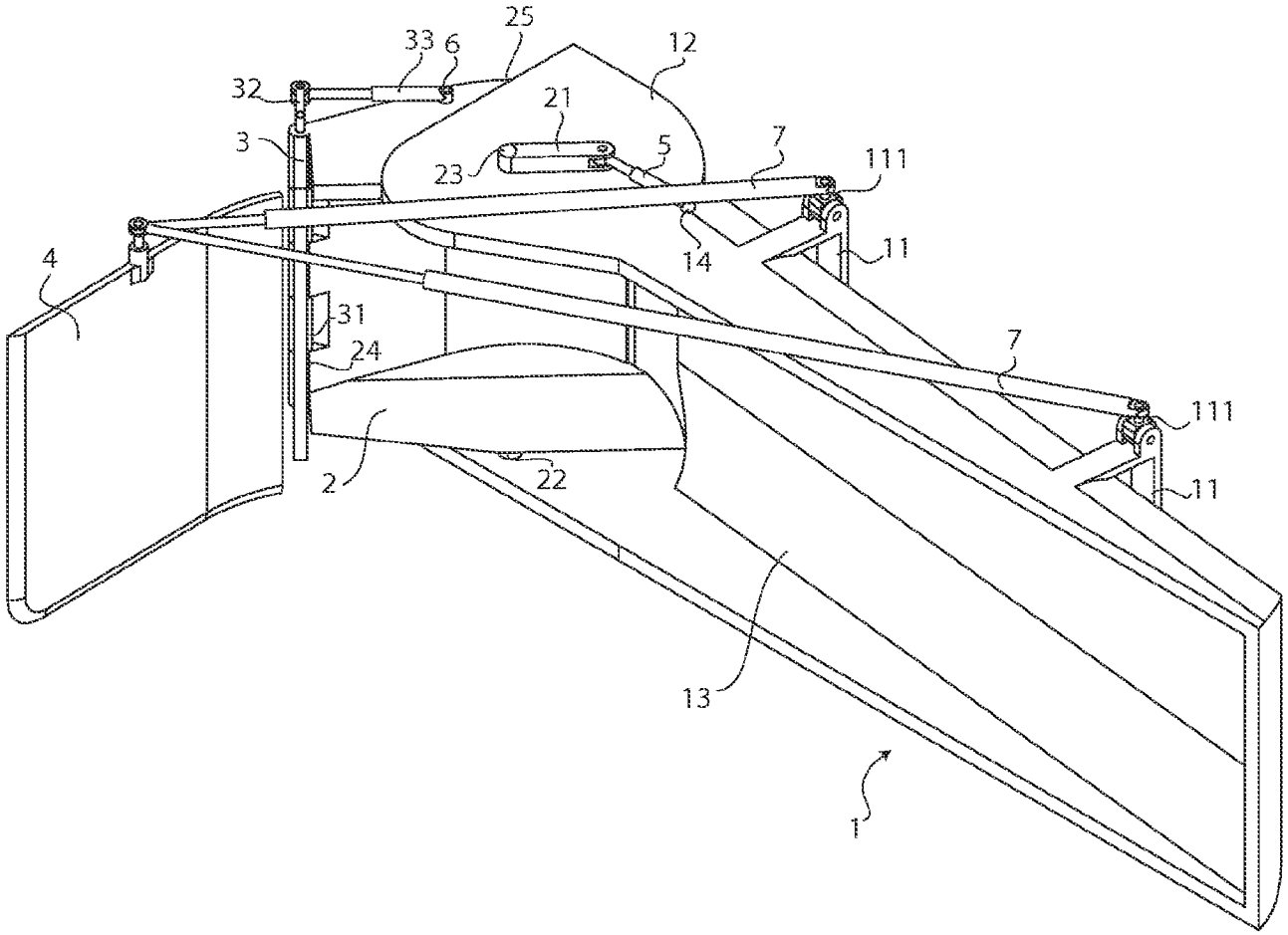
FIG. 4 is a perspective view of the present invention showing the butterfly gate closing towards the diverter.
Figure 5:
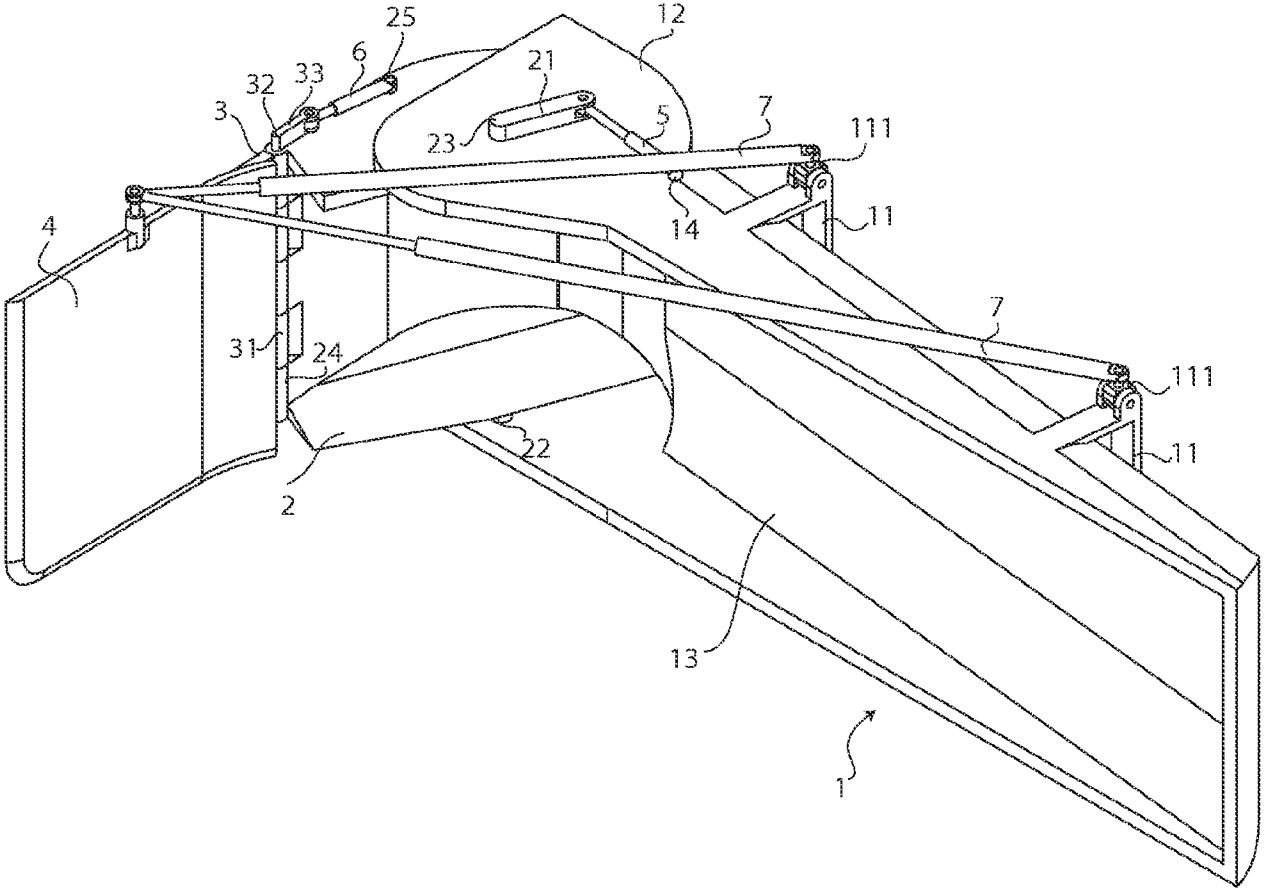
FIG. 5 is a perspective view of the present invention showing the blocker reopening as the butterfly gate is fully closed to seal the gap between the butterfly gate and the diverter.

In reference to FIG. 1, the present invention comprises of a main plow body 1, at least one butterfly gate 2, at least one blocker 3, a diverter 4, a gate actuator 5, a blocker actuator 6 and a pair of diverter supports 7. The main plow body 1, the at least one butterfly gate 2 and the at least one blocker 3 are jointly connected together and can be extended form a regularly shaped plow or compacted into a concave shape for retaining snow. The main plow body 1 is the main scoop of the plow assembly that collects and pushes snow to the side of the streets. The at least one butterfly gate 2 is used to interrupt the free flow of snow being scooped up and pushed to the side of a street by the main plow body 1. The blocker ensures a complete seal to prevent snow from escaping the at least one butterfly gate 2. The diverter 4 is an extension of the snow plow assembly that is able to further collect snow and ensure that snow is collected into the main plow body 1. In a closed and sealed position, the main plow body 1, the butterfly gate 2, the blocker 3, and the diverter 4 create one large, leak proof snow barrier for containing snow that otherwise would be disposed to the side of a street.

The main plow body 1 further comprises of a pair of truck mounts 11, at least one gate mount 12 and a scoop cavity 13. The at least one gate mount 12 is positioned on an end of the main plow body 1. The at least one gate mount 12 provides a space for the at least one butterfly gate 2 to be mounted. The at least one gate mount 12 is a circular hinge like cavity that is able to accommodate the at least one butterfly gate 2. The pair of truck mounts 11 is vertically positioned brackets that are positioned on a rear side of the main plow body 1. The pair of truck mounts 11 of evenly positioned on the rear side for even distribution of weight. The pair of truck mounts 11 provides the present invention with the ability to be mounted onto any truck for use. On the front side of the main plow body 1 is the scoop cavity 13. The scoop cavity 13 is a recessed space on the main plow body 1.

The at least one butterfly gate 2 further comprises of a top gate axle 21, a bottom gate axle 22, a gate actuator segment 23, and a blocker hinge 24. Each of the butterfly gate 2*s* are shaped like a loading hoe bucket that is positioned on its side. The top gate axle 21 and the bottom gate axle 22 provide the butterfly gate 2 a pivoting point in which it can be jointly mounted on to the at least one gate mount 12 of the main plow body 1. The top gate axle 21 is upwardly extended from the at least one butterfly gate 2 and the bottom gate axle 22 is downwardly extended from the at least one butterfly gate 2. The gate actuator segment 23 is perpendicularly extended from the top gate axle 21 and acts similarly as a handle for the opening and closing of the butterfly gate 2. The blocker hinge 24 is positioned on a first end of the butterfly gate 2 and is extended away from the main plow body 1.

The at least one blocker 3 further comprises of an inner blocker hinge 31, an inner blocker hinge axle 32, and a blocker actuator segments 33. The inner blocker hinge axle 32 is extended in concentric relationship to the inner blocker hinge 31. Together, the inner blocker hinge axle 32 and the inner blocker hinge 31 is aligned and jointly connected to the at least one butterfly gate 2. The blocker actuator segment 33, in a similar fashion to the gate actuator segment 23 of the at least one butterfly gate 2, is perpendicularly extended from the inner blocker hinge axle 32.

In reference to FIG. 1, the at least one butterfly gate 2, the at least one blocker 3, and the main plow body 1 is jointly connected in a chain to create the main section of the snow plow assembly. The top gate axle 21 and the bottom gate axle 22 of the at least one butterfly gate 2 are jointly secured to the at least one gate mount 12 of the main plow body 1. The top gate axle 21 is extended through the top side of the main blow body to allow the gate actuator segment 23 to be exposed and positioned atop the main plow body 1. The inner blocker hinge axle 32 is jointly secured to the blocker hinge 24 to secure to the at least one blocker 3 to the at least one butterfly gate 2. The inner blocker hinge axle 32 is traversed through the blocker hinge 24 and further extends above. This allows the blocker actuator segment 33 to be positioned atop the at least one butterfly gate 2. The gate actuator segment 23 and the blocker actuator segments 33 are positioned atop the main plow body 1 and the at least one butterfly gate 2 to allow external forces to be applied for their open and release controls. To control the opening and closing of the at least one butterfly gate 2, the main plow body 1 further comprises a gate actuator pin 14. The gate actuator pin 14 is upwardly extended from the main plow body 1 to provide a pivoting and mounting point for the gate actuator 5. The gate actuator 5 has a gate mount end and a gate push end. The gate mount end of the gate actuator 5 is jointly connected to the gate actuator pin 14. The gate push end is jointly connected to the gate actuator segment 23 of the at least one butterfly gate 2. To control the opening and closing of the at least one blocker 3, the at least one butterfly gate 2 further comprises a blocker actuator pin 25. The blocker actuator pin 25 is upwardly extended from the at least one butterfly gate 2 to provide a pivoting and mounting point for the blocker actuator 6. The blocker actuator 6 has a blocker mount end and a blocker push end. The blocker mount end of the blocker actuator 6 is jointly connected to the blocker actuator pin 25. The blocker push end is jointly connected to the blocker actuator segment 33 of the blocker. In the preferred embodiment of the present invention, the gate actuator 5 and the blocker actuator 6 is a hydraulics piston system that is able to push and pull on the gate actuator segment 23 and the blocker actuator segment 33, respectively. In other embodiments of the present invention, the gate actuator segment 23 and the blocker actuator segment 33 can be any other actuating means for pushing and pulling the gate actuator segment 23 and the block actuator segment 33.

The pair of truck mounts 11 further comprises diverter support 7 hinges 111. The diverter support hinges 111 are jointly connected to a top end of the pair of truck mounts 11. Each of the diverter supports 7 has a diverter mount end and a diverter push end. The diverter mount ends of the pair of diverter supports 7 are jointly connected to the diverter support hinges 111. The diverter push ends of the pair of diverter supports 7 are jointly connected to the diverter 4. In the preferred embodiment of the present invention, the diverter supports 7 are hydraulic actuating systems that are able to control the positioning of the diverter 4.

In one embodiment of the present invention, the gate actuator 5, the blocker actuator 6, and the pair of diverter supports 7 are hydraulic systems that can be connected to a custom plow truck for control. However, in another embodiment of the present invention, the hydraulic systems are controlled by a standalone system in which a remote can be extended into a truck for control and maneuvering of the snow plow assembly.

The present invention can operate in two complementary modes, a standard conventional mode and a GPS mode. The standard conventional mode allows the snow plow assembly to be used for the conventional removal of snow from the street pavement and deposited to the side curve area. The plow, angled to the curb is moved forward by a vehicle controlled by a user. When the present invention is simply pushing snow from the street pavement to the side curb area, the main plow body 1, the at least one butterfly gate 2, and the blocker are all lined-up to form one continuous/straight configurations. As the plow moves forward along the right hand side of the street, the scraped snow glides from the left-end of the plow to the right side of the plow.

As the plow nears driveway entrances, or any other small pathways, the snow plow assembly has the ability to reconfigure the positioning of the at least one butterfly gate 2 and the at least one blocker 3. In reference to FIG. 2-5, the snow plow assembly can convert into a closed position to collect snow away from small pathways to prevent the buildup of high snow ridges in unwanted areas. First the at least one blocker 3 rotates ninety degrees towards the at least one butterfly gate 2 and interrupts the free flow of snow. At the same time, the butterfly gate 2 begins to pivot within the gate mounts 12 to enlarge the pocket for a larger scoop space for the aggregation of additional snow. As the butterfly gate 2 rotates to the full extent, the blocker reopens to seal the butterfly gate 2 with the diverter 4 to complete one large leak-proof snow barrier for containing snow that would otherwise be disposed in front of a small pathway as a high snow ridge. As a result, the blockage of cross-streets, driveways, and other small pathways adjacent to the street being plowed is avoided.

Figure 6:
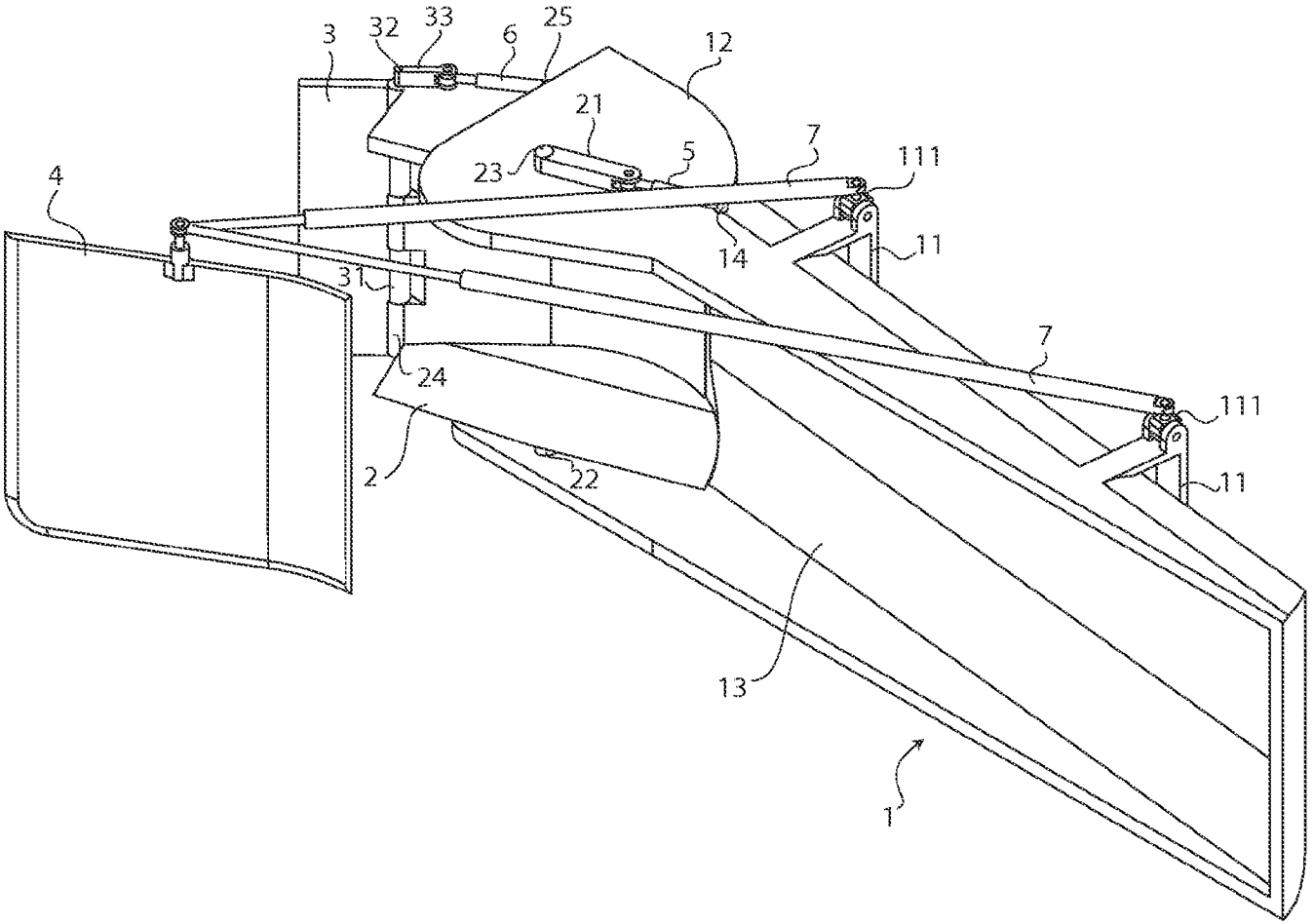
FIG. 6 is a perspective view of the present invention showing the diverter turned at a negative angle.

In reference to FIG. 6, the diverter 4 can be operated at a reversed angle (negative angle), to push any snow directly to the sidewalk. This allows snow to be first deflected towards the side of the street instead of towards the center of the street. This option can be used when the edge of the street is deposited with old and frozen snow. As a result, the plowing truck would have difficulty operating at the desired speed with the conventional configuration. By providing the negative angle, the diverter 4 is able to avoid reduced efficiency and the risk of damaging any equipment.

In another embodiment of the present invention, the snow plow assembly may be mounted onto an automatic and unmanned plow truck for automatic plowing of streets. In this embodiment of the present invention, the machine will be operated by means of GPS signal processor system that will utilize a signal/command interface and a control program. This allows the present invention to operate in GPS mode, where streets are detected and the snow plow assembly will automatically close and open correspondingly as the plow truck passes by small pathways such as driveways.

In another embodiment of the present invention, the snow plow assembly can comprise of two separate butterfly gates 2 and two separate blockers to be positioned on both ends of the main plow body 1. This allows the present invention to be operated for "left hand operation". This embodiment of the present invention is particularly useful for one way streets or left-hand drive streets. As a result, the users are not required to disassemble the snow plow assembly to be flipped to the other side.

Although the invention has been explained in relation to its preferred embodiment, it is to be understood that many other possible modifications and variations can be made without departing from the spirit and scope of the invention as hereinafter claimed.

What is claimed is:

1. A snow plow assembly comprises,
a main plow body;
at least one butterfly gate;
at least one blocker;
a diverter;
a gate actuator;
a blocker actuator;
a pair of diverter supports;
the main plow body comprises a pair of truck mounts, at least one gate mount, and a scoop cavity;
the at least one butterfly gate comprises a top gate axle, a bottom gate axle, a gate actuator segment, and a blocker hinge;
the at least one blocker comprises an inner blocker hinge, an inner blocker hinge axle, and a blocker actuator segment;
the at least one gate mount being positioned on an end of the main plow body;
the pair of truck mounts being vertically positioned on a rear side of the main plow body;
the scoop cavity being a recessed space on the main plow body;
the pair of truck mounts comprises diverter support hinges;
the diverter support hinges being jointly connected to a top end of the pair of truck mounts;
each of the diverter supports having a diverter mount end and a diverter push end;
the diverter mount ends of the pair of diverter supports being jointly connected to the diverter support hinges;
the diverter push ends of the pair of diverter supports being jointly connected to the diverter;
the top gate axle and the bottom gate axle of the at least one butterfly gate being jointly secured to the at least one gate mount of the main plow body;
the top gate axle extending through a top side of the main plow body;
the gate actuator segment being positioned atop the main plow body;
the inner blocker hinge axle being jointly secured to the blocker hinge of the at least one butterfly gate;
the inner blocker hinge axle being traversed through the blocker hinge; and
the blocker actuator segment being positioned atop the at least one butterfly gate.

2. The snow plow assembly as claimed in claim 1 comprises,
the top gate axle being upwardly extended from the at least one butterfly gate;
the bottom gate axle being downwardly extended from the at least one butterfly gate;
the gate actuator segment being perpendicularly extended from the top gate axle; and
the blocker hinge being positioned on a first gate end.

3. The snow plow assembly as claimed in claim 1 comprises,
the inner blocker hinge axle being extended in concentric relationship to the inner blocker hinge; and
the blocker actuator segment being perpendicularly extended from the inner blocker hinge axle.

4. The snow plow assembly as claimed in claim 1 comprises,
the main plow body further comprises a gate actuator pin;
the gate actuator having a gate mount end and a gate push end;
the gate mount end being jointly connected to the gate actuator pin; and
the gate push end being jointly connected to the gate actuator segment.

5. The snow plow assembly as claimed in claim 1 comprises,
the at least one butterfly gate comprises a blocker actuator pin;
the blocker actuator having a blocker mount end and a blocker push end;
the blocker mount end being jointly connected to the blocker actuator pin; and
the blocker push end being jointly connected to the blocker actuator segment.

6. A snow plow assembly comprises,
a main plow body;
at least one butterfly gate;
at least one blocker;
a diverter;
a gate actuator;
a blocker actuator;
a pair of diverter supports;
the main plow body comprises a pair of truck mounts, at least one gate mount, and a scoop cavity;
the at least one butterfly gate comprises a top gate axle, a bottom gate axle, a gate actuator segment, and a blocker hinge;
the at least one blocker comprises an inner blocker hinge, an inner blocker hinge axle, and a blocker actuator segment;
the top gate axle and the bottom gate axle of the at least one butterfly gate being jointly secured to the at least one gate mount of the main plow body;
the top gate axle extending through a top side of the main plow body;
the gate actuator segment being positioned atop the main plow body;
the inner blocker hinge axle being jointly secured to the blocker hinge of the at least one butterfly gate;
the inner blocker hinge axle being traversed through the blocker hinge; and
the blocker actuator segment being positioned atop the at least one butterfly gate.

7. The snow plow assembly as claimed in claim 6 comprises,
the at least one gate mount being positioned on an end of the main plow body;
the pair of truck mounts being vertically positioned on a rear side of the main plow body; and
the scoop cavity being a recessed space on the main plow body.

8. The snow plow assembly as claimed in claim 6 comprises,
the top gate axle being upwardly extended from the at least one butterfly gate;

the bottom gate axle being downwardly extended from the at least one butterfly gate;

the gate actuator segment being perpendicularly extended from the top gate axle; and the blocker hinge being positioned on a first gate end.

9. The snow plow assembly as claimed in claim 6 comprises, the inner blocker hinge axle being extended in concentric relationship to the inner blocker hinge; and the blocker actuator segment being perpendicularly extended from the inner blocker hinge axle.

10. The snow plow assembly as claimed in claim 6 comprises, the main plow body further comprises a gate actuator pin;

the gate actuator having a gate mount end and a gate push end;

the gate mount end being jointly connected to the gate actuator pin; and the gate push end being jointly connected to the gate actuator segment.

11. The snow plow assembly as claimed in claim 6 comprises, the at least one butterfly gate comprises a blocker actuator pin;

the blocker actuator having a blocker mount end and a blocker push end;

the blocker mount end being jointly connected to the blocker actuator pin; and the blocker push end being jointly connected to the blocker actuator segment.

12. The snow plow assembly as claimed in claim 7 comprises, the pair of truck mounts comprises diverter support hinges;

the diverter support hinges being jointly connected to a top end of the pair of truck mounts;

each of the diverter supports having a diverter mount end and a diverter push end;

the diverter mount ends of the pair of diverter supports being jointly connected to the diverter support hinges; and the diverter push ends of the pair of diverter supports being jointly connected to the diverter.

13. A snow plow assembly comprises, a main plow body;

at least one butterfly gate;

at least one blocker;

a diverter;

a gate actuator;

a blocker actuator;

a pair of diverter supports;

the main plow body comprises a pair of truck mounts, at least one gate mount, and a scoop cavity;

the at least one butterfly gate comprises a top gate axle, a bottom gate axle, a gate actuator segment, and a blocker hinge;

the at least one blocker comprises an inner blocker hinge, an inner blocker hinge axle, and a blocker actuator segment;

the top gate axle and the bottom gate axle of the at least one butterfly gate being jointly secured to the at least one gate mount of the main plow body;

the top gate axle extending through a top side of the main plow body;

the gate actuator segment being positioned atop the main plow body;

the inner blocker hinge axle being jointly secured to the blocker hinge of the at least one butterfly gate;

the inner blocker hinge axle being traversed through the blocker hinge;

the blocker actuator segment being positioned atop the at least one butterfly gate;

the main plow body further comprises a gate actuator pin;

the gate actuator having a gate mount end and a gate push end;

the gate mount end being jointly connected to the gate actuator pin;

the gate push end being jointly connected to the gate actuator segment;

the at least one butterfly gate comprises a blocker actuator pin;

the blocker actuator having a blocker mount end and a blocker push end;

the blocker mount end being jointly connected to the blocker actuator pin; and the blocker push end being jointly connected to the blocker actuator segment.

14. The snow plow assembly as claimed in claim 13 comprises, the at least one gate mount being positioned on an end of the main plow body;

the pair of truck mounts being vertically positioned on a rear side of the main plow body; and the scoop cavity being a recessed space on the main plow body.

15. The snow plow assembly as claimed in claim 13 comprises, the top gate axle being upwardly extended from the at least one butterfly gate;

the bottom gate axle being downwardly extended from the at least one butterfly gate;

the gate actuator segment being perpendicularly extended from the top gate axle; and the blocker hinge being positioned on a first gate end.

16. The snow plow assembly as claimed in claim 13 comprises, the inner blocker hinge axle being extended in concentric relationship to the inner blocker hinge; and the blocker actuator segment being perpendicularly extended from the inner blocker hinge axle.

17. The snow plow assembly as claimed in claim 14 comprises, the pair of truck mounts comprises diverter support hinges;

the diverter support hinges being jointly connected to a top end of the pair of truck mounts;

each of the diverter supports having a diverter mount end and a diverter push end;

the diverter mount ends of the pair of diverter supports being jointly connected to the diverter support hinges; and the diverter push ends of the pair of diverter supports being jointly connected to the diverter.

* * * * *